US005701573A

United States Patent [19]

Yoshiuchi et al.

[11] Patent Number: 5,701,573

[45] Date of Patent: Dec. 23, 1997

[54] IMAGE FORMING APPARATUS ADAPTED TO FEED CONTINUOUS ROLLED-SHEET PAPER BY CONTROLLING SLACK IN THE PAPER FOR THE ACCURATE CUTTING THEREOF

[75] Inventors: Katsuhiro Yoshiuchi; Hiroshi Kageyama; Yoko Nishi, all of Osaka, Japan

[73] Assignee: Mita Industrial Co., Ltd., Japan

[21] Appl. No.: 688,279

[22] Filed: Jul. 29, 1996

[30] Foreign Application Priority Data

Jul. 31, 1995 [JP] Japan ..... 7-195512

[51] Int. Cl.[6] ..... G03G 21/00

[52] U.S. Cl. ..... 399/384; 399/385; 399/387; 399/400

[58] Field of Search ..... 399/384, 385, 399/387, 400

[56] References Cited

U.S. PATENT DOCUMENTS

| | | | |
|---|---|---|---|
| 3,639,053 | 2/1972 | Spear, Jr. | 399/385 |
| 3,743,409 | 7/1973 | Fantuzzo | 399/385 |
| 4,839,732 | 6/1989 | Murakawi et al. | 399/385 X |
| 5,166,735 | 11/1992 | Malachowski | 399/400 X |
| 5,223,854 | 6/1993 | Shimizu | 399/385 X |
| 5,237,378 | 8/1993 | McEwen | 399/384 X |

*Primary Examiner*—Nestor R. Ramirez

*Attorney, Agent, or Firm*—Beveridge, DeGrandi, Weilacher & Young, L.L.P.

[57] ABSTRACT

An image forming apparatus capable of cutting a strip-shaped continuous sheet on which an image is formed to a desirable cutting length. A rolled-sheet is conveyed by registration rollers and the like. The rolled-sheet is further led to the vicinity of a photosensitive drum through pre-transfer rollers. The rolled-sheet to which a toner image has been transferred is subjected to toner fixing processing by a fixing device. When the leading end of the rolled-sheet reaches the pre-transfer rollers, the rotational speed of a sheet feeding motor is increased during a predetermined time. Consequently, the sheet conveying speed on the upstream side of the pre-transfer rollers in a direction of sheet conveyance is increased, thereby forming slack in a sheet portion between the registration rollers and the pre-transfer rollers. Consequently, tension exerted on a sheet portion between the fixing device and the pre-transfer rollers does not affect the conveyance of the sheet by the registration rollers. If operation timing of a cutting mechanism is determined on the basis of the number of output pulses of a pulse output unit for detecting rotation of the sheet feeding motor, therefore, the rolled-sheet can be reliably cut to a desirable length.

9 Claims, 8 Drawing Sheets

IMAGE FORMING APPARATUS ADAPTED TO FEED CONTINUOUS ROLLED-SHEET PAPER BY CONTROLLING SLACK IN THE PAPER FOR THE ACCURATE CUTTING THEREOF

BACKGROUND OF THE INVENTION

1. Field of the Invention

The present invention relates to an image forming apparatus for forming an image on a strip-shaped continuous sheet and cutting a sheet portion where the image is formed.

2. Description of the Related Art

Conventionally, a copying machine so adapted as to optically scan an original, form an electrostatic latent image corresponding to the original on a photoreceptor on the basis of the scanning, develop the electrostatic latent image into a toner image, and then transfer the toner image to copy sheets has been widely used. As such a copying machine, a copying machine capable of copying an original of large size, for example, A0 size in Japanese Industrial Standard (JIS) (hereinafter referred to as "A0 size") has been provided.

The copying machine capable of copying an original of large size generally comprises a reading mechanism capable of reading the original of large size, and a conveying mechanism for conveying copy sheets of large size corresponding to the original.

As the copy sheets, a strip-shaped rolled-sheet wound around a rolled-sheet body is generally used. Specifically, the rolled-sheet is pulled out from the rolled-sheet body and is conveyed, and a toner image is transferred to the rolled-sheet which is being conveyed. The rolled-sheet is cut at predetermined timing, and a sheet obtained by cutting the rolled-sheet is discharged. The reason why the rolled-sheet is cut into the sheet is that previously cut sheets of large size such as A0 size are inconvenient in handling, and requires a wide containing space.

FIG. 8 is a conceptual diagram for explaining the form of conveying a rolled-sheet pulled out from a rolled-sheet body. A rolled-sheet 101 pulled out from a rolled-sheet body 100 and waiting in a home position HP is conveyed in a direction of conveyance K by sheet feeding rollers FL, conveying rollers HL, registration rollers LL, and pre-transfer rollers TL, and is led to a photoreceptor 102 when copying is started. Thereafter, a toner image formed on the photoreceptor 102 is transferred to the rolled-sheet 101 by a transferring corona discharger 103. The rolled-sheet 101 after the transfer is led to a fixing device 104, where toner particles on the surface of the rolled-sheet 101 are fixed by heating and application of pressure, after which the rolled-sheet 101 is discharged to the outside of the copying machine by a discharge roller EL.

A cutter mechanism 105 is provided between the conveying rollers HL and the registration rollers LL. The cutter mechanism 105 is for cutting the rolled-sheet 101. The sheet feeding rollers FL, the conveying rollers HL, and the registration rollers LL are driven to rotate by a sheet feeding motor PFM. A pulse output unit 106 is provided in relation to a driving shaft MJ of the sheet feeding motor PFM. The pulse output unit 106 outputs one pulse every time the driving shaft MJ is angularly displaced through a predetermined angle. Consequently, the pulse output unit 106 outputs a pulse signal in a period corresponding to the rotational speed of the sheet feeding motor PFM.

The cutting of the rolled-sheet 101 in the cutter mechanism 105 is carried out on the basis of the number of pulses outputted from the pulse output unit 106 so that the length of a sheet obtained by the cutting (hereinafter referred to as "the cutting length") is fixed.

More specifically, the registration rollers LL or the like is driven to rotate by the sheet feeding motor PFM, whereby the number of output pulses of the pulse output unit 106 is proportional to the feeding length (the conveying sheet length). When the reference number of pulses corresponding to the cutting length is previously set, and the cutter mechanism 105 is operated at timing at which the number of pulses outputted from the pulse output unit 106 reaches the reference number of pulses, the cutting length should be fixable.

However, there may, in some cases, be a case where the relationship between the number of pulses outputted from the pulse output unit 106 and the conveying sheet length is not a fixed relationship. This is a case where the rolled-sheet 101 is cut to a cutting length which is not less than the length of a sheet conveying path between the cutter mechanism 105 and the fixing device 104.

More specifically, the sheet conveying speed of the fixing device 104 is generally set to a higher speed than the sheet conveying speed of the registration rollers LL or the like. That is, tension is exerted on the rolled-sheet 101 which has entered the fixing device 104, so that the rolled-sheet 101 enters a state where it is pulled by the fixing device 104. Consequently, the sheet 101 is prevented from being wrinkled at the time of fixing. However, the sheet conveying speed of the fixing device 104 varies depending on a temperature at which the toner particles are fixed by heating. Consequently, the tension is not fixed but varies. For example, if large tension is exerted, the rolled-sheet 101 may, in some cases, be conveyed while sliding on the surface of the registration rollers LL or the like. Thus, the relationship between the number of output pulses of the pulse output unit 106 and the conveying sheet length is not necessarily a fixed relationship due to non-uniform tension produced on the sheet 101.

When the rolled-sheet 101 is cut to a cutting length which is not less than the length of the sheet conveying path between the cutter mechanism 105 and the fixing device 104, therefore, the cutting length varies.

SUMMARY OF THE INVENTION

An object of the present invention is to solve the above-mentioned technical problems and provide an image forming apparatus capable of cutting a strip-shaped continuous sheet on which an image is formed to a desirable cutting length.

Another object of the present invention is to provide a method of feeding a strip-shaped continuous sheet on which an image is formed so that the sheet can be cut to a desirable cutting length.

An image forming apparatus according to the present invention comprises image forming means for forming an image on a sheet, a feeding roller for feeding a strip-shaped continuous sheet to the image forming means, a pre-image-formation roller provided between the feeding roller and the image forming means, cutting means provided on the upstream side of the pre-image-formation roller with respect to a direction of sheet conveyance for cutting the strip-shaped continuous sheet, pre-image-formation roller driving means for driving the pre-image-formation roller to rotate so that the sheet conveying speed of the pre-image-formation roller is equal to a predetermined speed, and feeding roller driving means for driving the feeding roller to rotate. The image forming apparatus further comprises driving controlling means for controlling the feeding roller driving means so that the sheet conveying speed of the feeding roller is higher than the sheet conveying speed of the pre-image-formation roller during a predetermined time period after the leading end of the continuous sheet has reached the pre-image-formation roller.

In this construction, the sheet conveying speed of the feeding roller is increased during the predetermined time period after the leading end of the continuous sheet has reached the pre-image-formation roller. Therefore, slack is formed in the sheet between the feeding roller and the pre-image-formation roller. That is, the sheet in this portion becomes a loop shape. As a result, even if tension is applied to a sheet portion on the downstream side of the pre-image-formation roller with respect to the direction of sheet conveyance, the tension does not affect a sheet portion on the upstream side of the pre-image-formation roller in the direction of sheet conveyance. Even when the tension is not fixed but varies, the variation in the tension is absorbed in a slack portion of the sheet.

Therefore, the tension does not affect the cutting by the cutting means provided on the upstream side of the pre-image-formation roller in the direction of sheet conveyance. Consequently, the continuous sheet can be reliably cut to a desirable length.

The image forming apparatus according to the embodiment of the present invention further comprises sheet feeding length detecting means for detecting a sheet feeding length by the feeding roller, and cutting controlling means for driving the cutting means in response to that the sheet feeding length detected by the sheet feeding length detecting means has reached a predetermined value. Since the tension does not affect the sheet portion on the upstream side of the pre-image-formation roller with respect to the direction of sheet conveyance as described above, the sheet feeding length by the feeding roller is not affected by the tension. If the sheet feeding length by the feeding roller is detected, and the timing of driving of the cutting means is set on the basis of the detected sheet feeding length, therefore, the sheet can be reliably cut to a desirable length.

It is preferable that the feeding roller comprises a registration roller, and the cutting means is provided on the upstream side of the registration roller with respect to the direction of sheet conveyance. Consequently, the sheet can be cut in a position where there is no slack.

The image forming apparatus according to the embodiment of the present invention further comprises a post-treatment roller provided on the downstream side of the image forming means in the direction of sheet conveyance, and post-treatment roller driving means for driving the post-treatment roller to rotate so that the sheet conveying speed of the post-treatment roller is higher than the sheet conveying speed of the pre-image-formation roller. In this construction, the tension is exerted on a sheet portion between the post-treatment roller and the pre-image-formation roller. The tension does not adversely affect the cutting of the sheet as described above.

In the embodiment of the present invention, the image forming means is for forming an image on a sheet by an electrophotographic process, and the post-treatment roller is a fixing roller for fixing to the sheet the image transferred to the sheet. In this case, the tension is applied to a sheet portion between the fixing roller and the pre-image-formation roller, whereby the sheet can be prevented from being wrinkled at the time of fixing.

It is preferable that the sheet conveying speed of the feeding roller is made higher than the sheet conveying speed of the pre-image-formation roller for sufficient time to hold a state where there is slack in the sheet between the feeding roller and the pre-image-formation roller until completion of the cutting of the sheet by the cutting means.

Consequently, the tension exerted on the sheet does not adversely affect the cutting of the sheet. That is, the sheet can be reliably cut to a desirable length.

A sheet feeding method according to the present invention comprises the steps of providing slack in a sheet short of image forming means, measuring a sheet feeding length short of the slack, and cutting the sheet when the measured sheet feeding length has reached a predetermined value.

According to this method, slack is provided in the sheet short of the image forming means. Even if tension is exerted on a sheet portion succeeding the image forming means, therefore, the tension does not adversely affect the cutting of the sheet. Therefore, the sheet can be reliably cut to a desirable length.

By making the sheet conveying speed of the feeding roller for feeding the sheet toward the image forming means higher than the sheet conveying speed of the pre-image-formation roller short of the image forming means for predetermined time, slack is provided in the sheet.

The sheet feeding length can be measured by detecting rotation of the feeding roller.

It is preferable that the feeding roller comprises a registration roller, and the sheet is cut on the upstream side of the registration roller with respect to a direction of sheet conveyance. Consequently, the sheet can be satisfactorily cut in a position where there is not slack.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
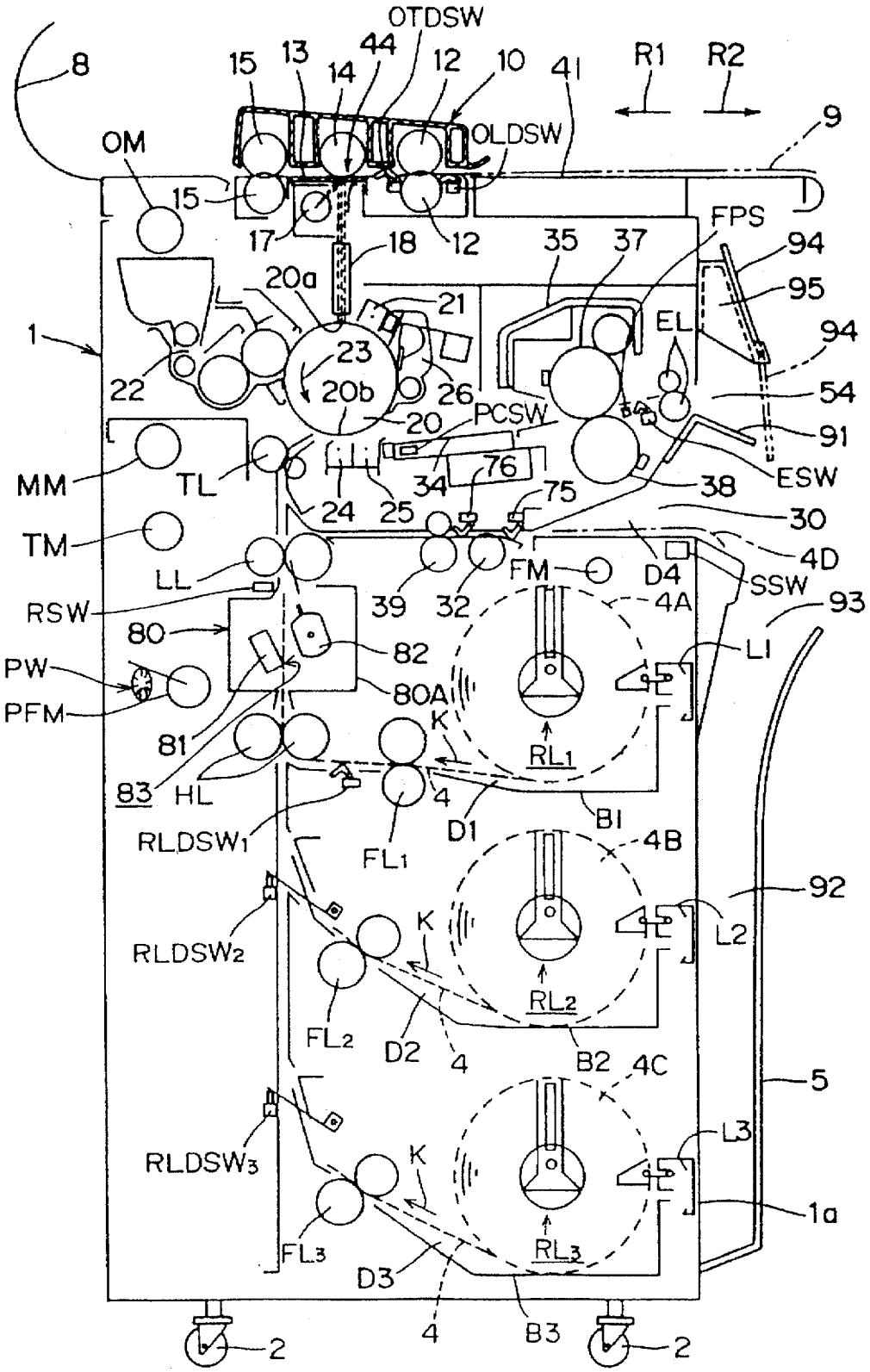
FIG. 1 is a cross-sectional view schematically showing the internal construction of a copying machine according to one embodiment of the present invention.
Figure 2:
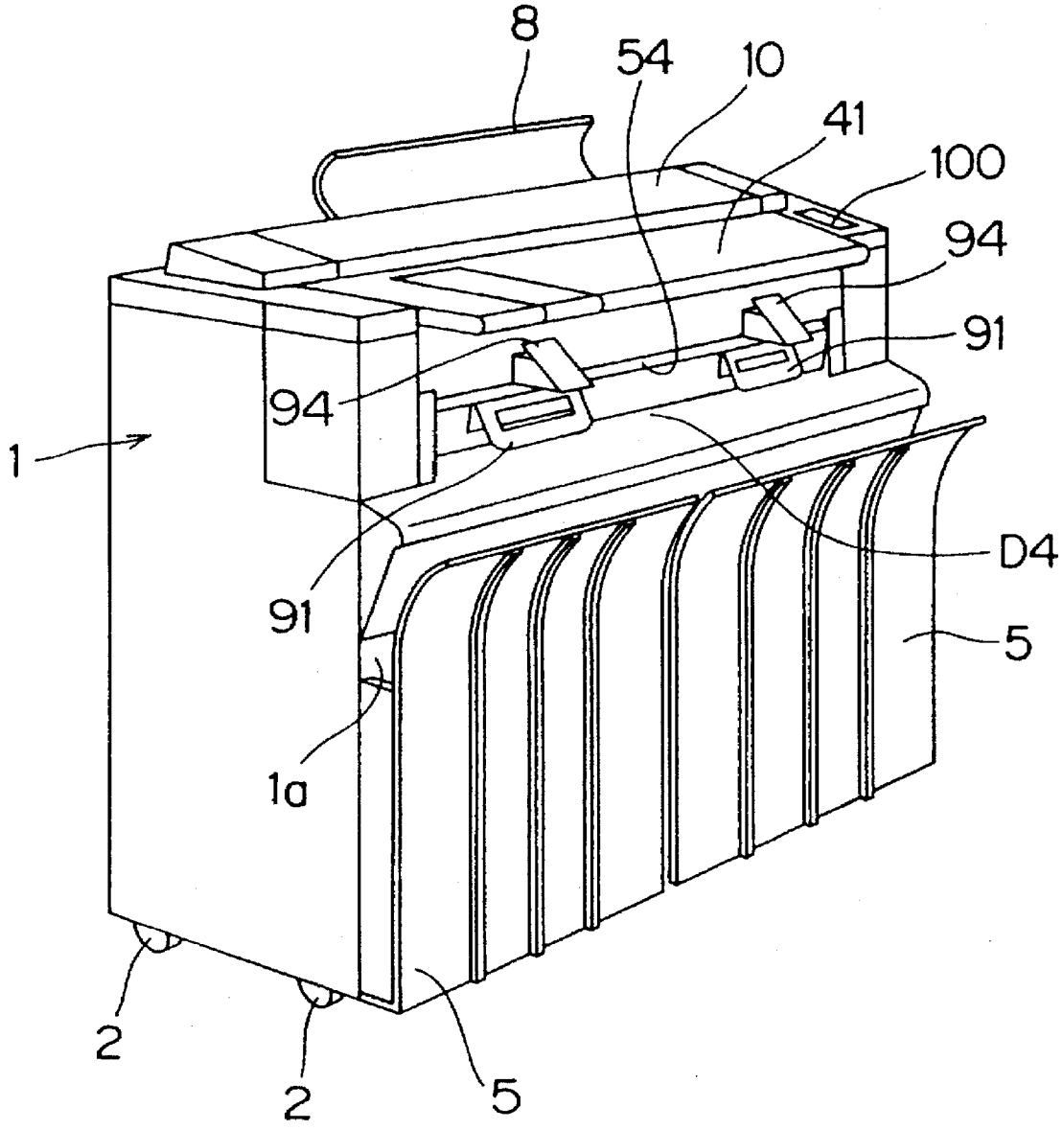
FIG. 2 is a perspective view showing the appearance of the copying machine shown in FIG. 1.
Figure 3:
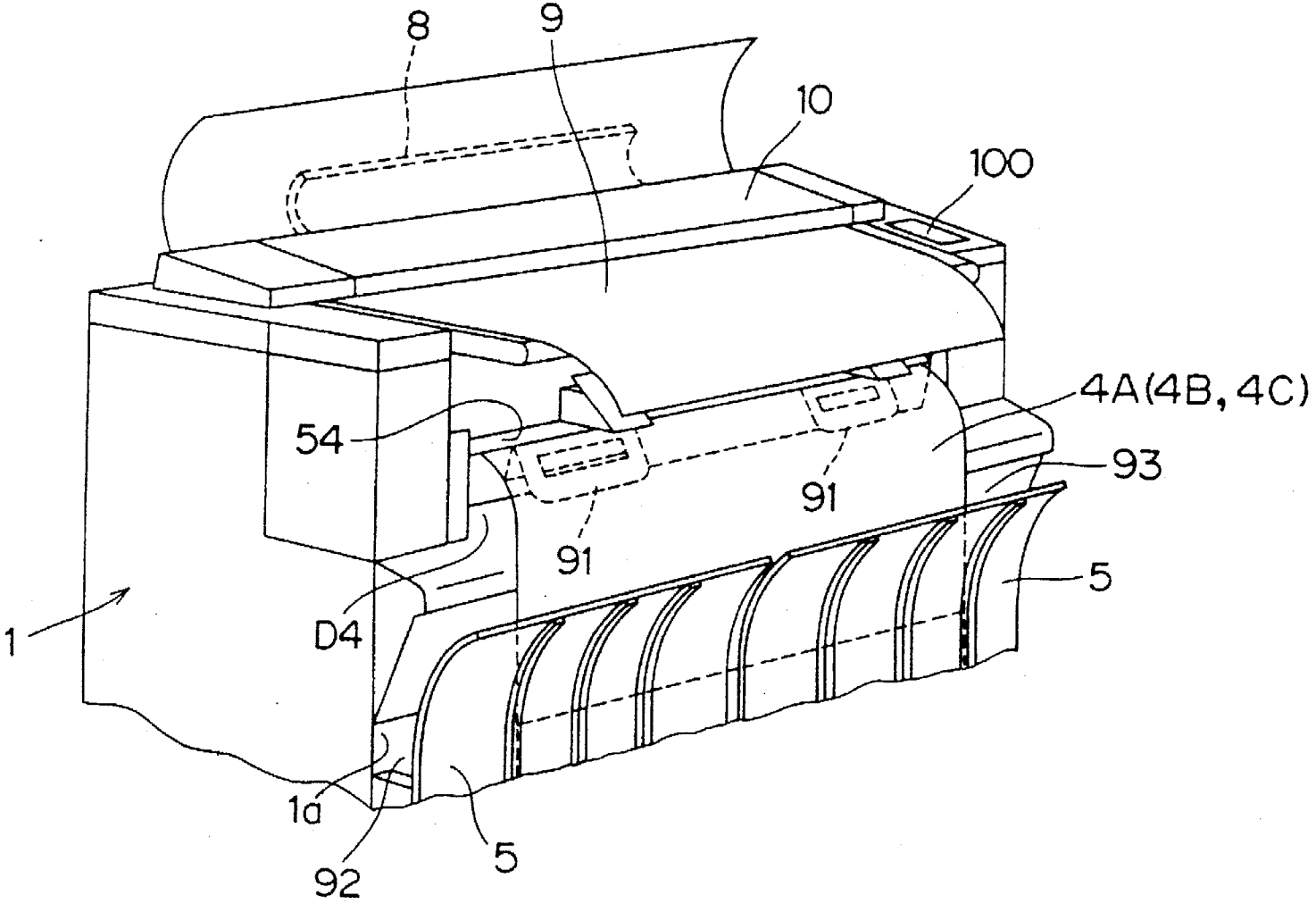
FIG. 3 is a perspective view showing the appearance at the time of copying of the copying machine shown in FIG. 1 in a partially enlarged manner.

FIG. 1 is a cross sectional view schematically showing the internal construction of a copying machine in one embodiment of an image forming apparatus according to the present invention. FIG. 2 is a perspective view showing the appearance of the copying machine. Further, FIG. 3 is a perspective view showing the appearance at the time of copying of the copying machine in a partially enlarged manner. The copying machine can copy an original of large size such as A0 size. In the copying machine, the original is conveyed, while an original surface is illuminated and scanned by an optical system fixedly arranged. An image is formed on the basis of the illumination and scanning.

Caster wheels 2 are mounted on the bottom of a main body 1 of the copying machine. Consequently, the main body 1 of the copying machine is made movable. An original conveying section 10 is provided on the top of the main body 1 of the copying machine. The original conveying section 10 is for conveying an original 9 along an original conveying path 41 formed on the upper surface of the main body 1 of the copying machine. A discharge port 54 for discharging a sheet to which a toner image has been transferred is opened on a front surface 1*a* of the main body 1 of the copying machine. The sheets discharged from the discharge port 54 are dropped with the leading ends directed downward while being guided by guiding members 91 shown in FIG. 3. The dropped sheets are successively contained in a pocket 92 through an inlet opening 93. The pocket 92 is formed by a front cover 5 along the front surface 1*a* of the main body 1 of the copying machine. An operation section 100 is provided in an end of the upper surface of the main body 1 of the copying machine. Switches, keys, and the like for performing various setting related to copying are arranged in the operation section 100.

In FIG. 1, sheet containing cases B1, B2, and B3 (hereinafter generically called "a sheet containing case B") are arranged in a portion below the center along the height of the main body 1 of the copying machine. The sheet containing cases B1, B2, and B3 are for respectively containing rolled-sheet bodies 4A, 4B, and 4C around which rolled-sheets 4 which are strip-shaped continuous sheets are wound. Examples of the rolled-sheet 4 include plain paper, a film, and tracing paper. The sheet containing cases B1, B2, and B3 respectively comprise rewind rollers $RL_1$, $RL_2$, and $RL_3$ also serving as roll shafts. The rolled-sheet bodies 4A to 4C are constructed by respectively winding the rolled-sheets 4 around the rewind roller $RL_1$ to $RL_3$.

The sheet containing case B is arranged in the main body 1 of the copying machine so that it can be pulled out. The sheet containing cases B1, B2, and B3 respectively have levers L1, L2, and L3 for easily pulling out the sheet containing cases. The front surface 1*a* of the main body 1 of the copying machine can be opened and closed in the lateral direction in FIG. 1. In relation thereto, the main body 1 of the copying machine is provided with a safety switch SSW for detecting the opening and closing of the front surface 1*a*. Specifically, the safety switch SSW is turned on when the front surface 1*a* is opened, while being turned off when the front surface 1*a* is closed.

Furthermore, a bypass conveying path D4 is provided in the center of the main body 1 of the copying machine. The bypass conveying path D4 is for feeding to the main body 1 of the copying machine a cut sheet 4D introduced into a manual sheet feeding section 30 provided on the front surface 1*a* of the main body 1 of the copying machine. Examples of the cut sheet 4D include cut sheets of A0 size to A4 size.

From the rolled-sheet body 4A in the upper stage, the rolled-sheet 4 is conveyed in a direction of conveyance K along a first conveying path D1 leading to a photosensitive drum 20 successively through the rewind roller $RL_1$, sheet feeding rollers $FL_1$, a first leading end detecting switch $RLDSW_1$ for detecting the leading end of the rolled-sheet 4 conveyed, conveying rollers HL, a cutter mechanism 80, a registration switch RSW, registration rollers LL, and pre-transfer rollers TL. The sheet feeding rollers FL, the conveying rollers HL and the registration rollers LL correspond to a feeding roller, and the pre-transfer rollers TL correspond to a pre-image-formation roller.

The first leading end detecting switch $RLDSW_1$ is turned on if the rolled-sheet 4 exists in a position where the switch is disposed, while being turned off if it does not exist at the position. Further, the registration switch RSW is employed when the rolled-sheet 4 is engaged with the registration rollers LL, which is turned on if the rolled-sheet 4 exists in a position where the switch is disposed, while being turned off if it does not exist at the position.

From the rolled-sheet body 4B in the intermediate stage, the rolled-sheet 4 is conveyed in the direction of conveyance K along a second conveying path D2 leading to the photosensitive drum 20 successively through the rewind roller RL, sheet feeding rollers $FL_2$, a second leading end detecting switch $RLDSW_2$ for detecting the leading end of the rolled-sheet 4 conveyed, the conveying rollers HL, the cutter mechanism 80, the registration switch RSW, the registration rollers LL, and the pre-transfer rollers TL. A path succeeding the conveying rollers HL is common to the first conveying path D1.

From the rolled-sheet body 4C in the lower stage, the rolled-sheet 4 is conveyed in the direction of conveyance K along a third conveying path D3 leading to the photosensitive drum 20 successively through the rewind roller $RL_3$, sheet feeding rollers $FL_3$, a third leading end detecting switch $RLDSW_3$ for detecting the leading end of the rolled-sheet 4 conveyed, the conveying rollers HL, the cutter mechanism 80, the registration switch RSW, the registration rollers LL, and the pre-transfer rollers TL. A path succeeding the conveying rollers HL is common to the first conveying path D1.

The bypass conveying path D4 is a path for leading to the photosensitive drum 20 the cut sheet 4D introduced from the manual sheet feeding section 30 successively through a fourth leading end detecting switch 75 for detecting the leading end of the cut sheet 4D conveyed, a separating roller 32 for separating cut sheets 4D (separating one at a time) by sliding contact of a friction plate (not shown), a fifth leading end detecting switch 76 for detecting the leading end of the cut sheet 4D conveyed, conveying rollers 39, and the pre-transfer rollers TL. A path succeeding the pre-transfer rollers TL in the bypass conveying path D4 is common to the first conveying path D1.

The second, third, fourth and fifth leading end detecting switches $RLDSW_2$, $RLDSW_3$, 75 and 76 have the same construction as the first leading end detecting switch $RLDSW_1$.

The cutter mechanism 80 comprises in a casing 80A a longitudinal fixed blade 81 extending in a direction perpendicularly intersecting the direction of conveyance K of the rolled-sheet 4 and a rotating blade 82 for cutting the rolled-sheet 4 between the fixed blade 81 and the rotating blade 82. In the cutter mechanism 80, the rotating blade 82 is driven, whereby the rolled-sheet 4 is cut in a position for cutting 83 by interaction between the rotating blade 82 and the fixed blade 81.

The original conveying section 10 is for conveying the original 9 and is capable of switching the direction of conveyance between a forward direction R1 and a reverse direction R2. An image forming operation is performed when the original is conveyed in the forward direction R1. When a plurality of copies are made from the same original, the original conveying section 10 alternatively switches the direction of conveyance to the forward direction R1 and the reverse direction R2, to convey the original 9. The above-mentioned original conveying path 41 is formed on the upper surface of the main body 1 of the copying machine, extending to a position where it projects from the upper surface of the main body 1 of the copying machine on the upstream side of the original conveying section 10 with respect to the forward direction R1.

The above-mentioned original conveying section 10 is constructed by successively arranging a first original end detecting switch OLDSW, first conveying rollers 12, a second original end detecting switch OTDSW, a second conveying roller 14, and third conveying rollers 15 along the forward direction R1.

The first conveying rollers 12 are for leading the set original to a transparent plate 13 in the original conveying section 10. The driving of the first conveying rollers 12 is started in response to the switching of the first original end detecting switch OLDSW from its off state to its on state to detect the leading end of the original 9 (an end on the downstream side in the forward direction R1). The second conveying roller 14 is for bringing the original 9 into contact with the transparent plate 13 in order to make slit exposure of the original 9, which is provided in a position opposed to the transparent plate 13. The third conveying rollers 15 are for discharging the original 9 after the exposure.

Furthermore, the second original end detecting switch OTDSW is switched from its off state to its on state when the original 9 is conveyed in the forward direction R1, to detect the leading end of the original 9 in the forward direction R1. The conveyance of the rolled-sheet 4 is started in response to the fact that the second original end detecting switch OTDSW is turned on. As a result, the conveyance of the original 9 and the conveyance of the rolled-sheet 4 are synchronized with each other.

In the present embodiment, the length of a sheet feeding path of the rolled-sheet 4 from the cutter mechanism 80 to a position for transfer **20*b* of the photosensitive drum 20 is set to a larger length than the length of an original feeding path from the first original end detecting switch OLDSW to a position for original exposure 44 by a peripheral length from a position for exposure 20*a* of the photosensitive drum 20 to the position for transfer 20*b*. Consequently, an image corresponding to the trailing end of the original 9 can be formed at the trailing end of the rolled-sheet 4**.

The second original end detecting switch OTDSW is switched from its on state to its off state when the original 9 is conveyed in the reverse direction R2, to detect the leading end of the original 9. In response to that the second original end detecting switch OTDSW is turned off, the driving of the conveying rollers 12, 14 and 15 is stopped. At this time, the original 9 is readily available for the subsequent copying operation with the leading end held by the conveying rollers 12.

Reference numeral 8 denotes a reversing member for reversing the direction of the original to prevent the original 9 from dropping into the back of the main body 1 of the copying machine.

A light source 17 for illuminating the original surface of the original 9 is fixedly arranged in relation to the transparent plate 13. Light from the light source 17 is irradiated onto the surface of the original through the transparent plate 13. Light reflected from the surface of the original 9 is directed to the surface of the photosensitive drum 20 provided inside the main body 1 of the copying machine through a Selfoc lens 18. The surface of the photosensitive drum 20 before being exposed by the light from the Selfoc lens 18 is uniformly charged by a charging corona discharger 21. Therefore, an electrostatic latent image corresponding to an original image is formed on the surface of the photosensitive drum 20 after being exposed. The electrostatic latent image is developed into a toner image by a developing device 22. The toner image is led to the vicinity of the transferring corona discharger 24 by the rotation of the photosensitive drum 20 in a direction indicated by an arrow 23.

On the other hand, the rolled-sheet 4 led toward the photosensitive drum 20 from one of the sheet feeding paths D1, D2 and D3 is further led to the vicinity of the transferring corona discharger 24. The toner image on the surface of the photosensitive drum 20 is transferred to the rolled-sheet 4 by corona discharges in the transferring corona discharger 24. The rolled-sheet 4 to which the toner image has been transferred is separated from the surface of the photosensitive drum 20 by corona discharges in a separating corona discharger 25, and is further led to a fixing device 35 through a conveying path 34. The photosensitive drum 20, the charging corona discharger 21, the developing device 22, the transferring corona discharger 24, and the like thus constitute image forming means.

The conveying path 34 is provided with a conveying switch PCSW. The conveying switch PCSW is arranged to be turned on if the rolled-sheet 4 exists in the conveying path 34, while being turned off if it does not exist in the path.

In the fixing device 35, the rolled-sheet 4 is pressed and heated between a heat roller 37 and a pressure roller 38, whereby toner particles are fixed to the surface of the rolled-sheet 4. The heat roller 37 and the pressure roller 38 correspond to a fixing roller (a post-treatment roller). The rolled-sheet 4 to which the toner particles have been fixed is discharged toward the outside of the main body 1 of the copying machine by discharge rollers EL through a discharge pulse switch FPS and a discharge switch ESW, and is contained in the pocket 92 through the guiding members 91 as described above. On the other hand, the toner particles remaining on the surface are the photosensitive drum 20 after transferring the toner image are removed by a cleaning device 26, to prepare for formation of the subsequent electrostatic latent image. The toner image is also similarly transferred, fixed and discharged into the pocket 92 with respect to the cut sheet 4D led to the photosensitive drum 20 through the bypass sheet feeding path D4.

The discharge switch ESW is turned on if the rolled-sheet 4 exists in a position where the switch is disposed, while being turned off if it does not exist at the position.

Guide assisting plates 94 are arranged above the guiding members 91. The guide assisting plates 94 are rotatably supported on stays 95 mounted on the front surface **1*a* of the main body 1 of the copying machine. The guide assisting plates 94 are rotatably displaceable between a guiding position where they hang down ahead of the guiding members 91 to guide the discharged rolled-sheet 4, in cooperation with the guiding members 91, to the pocket 92 (indicated by a two-dot and dash line in FIG. 1) and a containing position where they are held on the stays 95** (indicated by a solid line in FIG. 1).

The copying machine is provided with a main motor MM for driving the photosensitive drum 20 and the developing device 22, a pre-transfer motor TM serving as pre-image-formation roller driving means for driving the pre-transfer rollers TL, a sheet feeding motor PFM serving as feeding roller driving means for driving a group of rollers for feeding the sheets 4 and 4D toward the pre-transfer rollers TL, a fixing motor FM serving as post-treatment roller driving means for driving the heat roller 37 and the pressure roller 38 in the fixing device 35, and an original conveying motor OM for driving the rollers in the original conveying section 10. The sheet feeding motor PFM also drives the cutter mechanism 80.

A pulse output unit PW is provided in relation to a driving shaft of the sheet feeding motor PFM. The pulse output unit PW outputs one pulse every time the driving shaft of the sheet feeding motor PFM is angularly displaced through a predetermined angle. Consequently, the pulse output unit PW outputs a pulse signal in a period corresponding to the rotational speed of the sheet feeding motor PFM.

Figure 4:
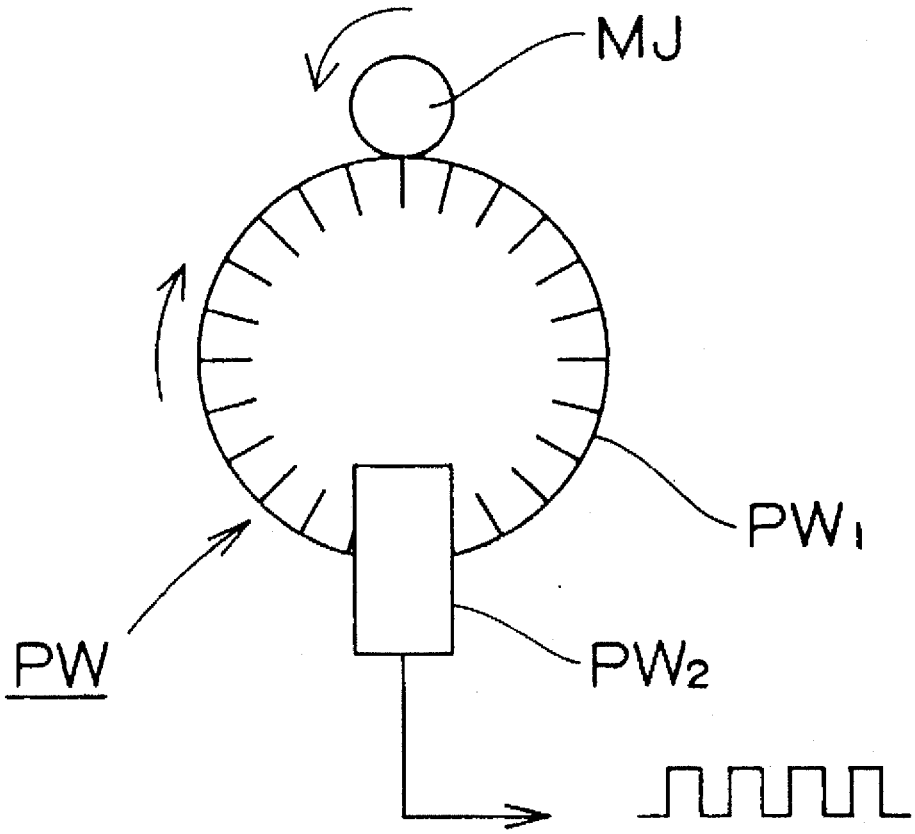
FIG. 4 is a schematic view showing the construction of a pulse output unit provided in the copying machine shown in FIG. 1.

FIG. 4 is a diagram for explaining the construction of the pulse output unit PW. The pulse output unit PW includes a rotating disk $PW_1$ of which peripheral portion abuts against the driving shaft MJ of the sheet feeding motor PFM in order that its peripheral portion rotates as the driving shaft MJ rotates. The pulse output unit PW also includes a light-emitting/light-receiving element pair $PW_2$ associated with the rotation disk $PW_1$. A number of slits are formed radially, at equal spacing, with respect to a rotation center in the peripheral portion of the rotating disk $PW_1$. The light-emitting/light-receiving element pair $PW_2$ is arranged so that the peripheral portion of the rotating disk $PW_1$ is interposed between the light emitting element and the light receiving element which constitute the element pair $PW_2$. Light emitted by the light emitting element is fed to the light receiving element through one of the slits of the rotating disk $PW_1$.

The rotating disk $PW_1$ rotates as the driving shaft MJ of the sheet feeding motor PFM rotates. On the other hand, light emitted from the light emitting element passes through one of the slits or is intercepted in a portion other than the slits as the rotating disk $PW_1$ rotates. Consequently, an output of the light receiving element is a pulse signal in response to intermittent receiving of light. Therefore, the number of pulse signals is proportional to the total amount of angular displacement of the driving shaft MJ of the sheet feeding motor PFM, and the period of the pulse signal depends to the rotational speed of the sheet feeding motor PFM.

Figure 5:
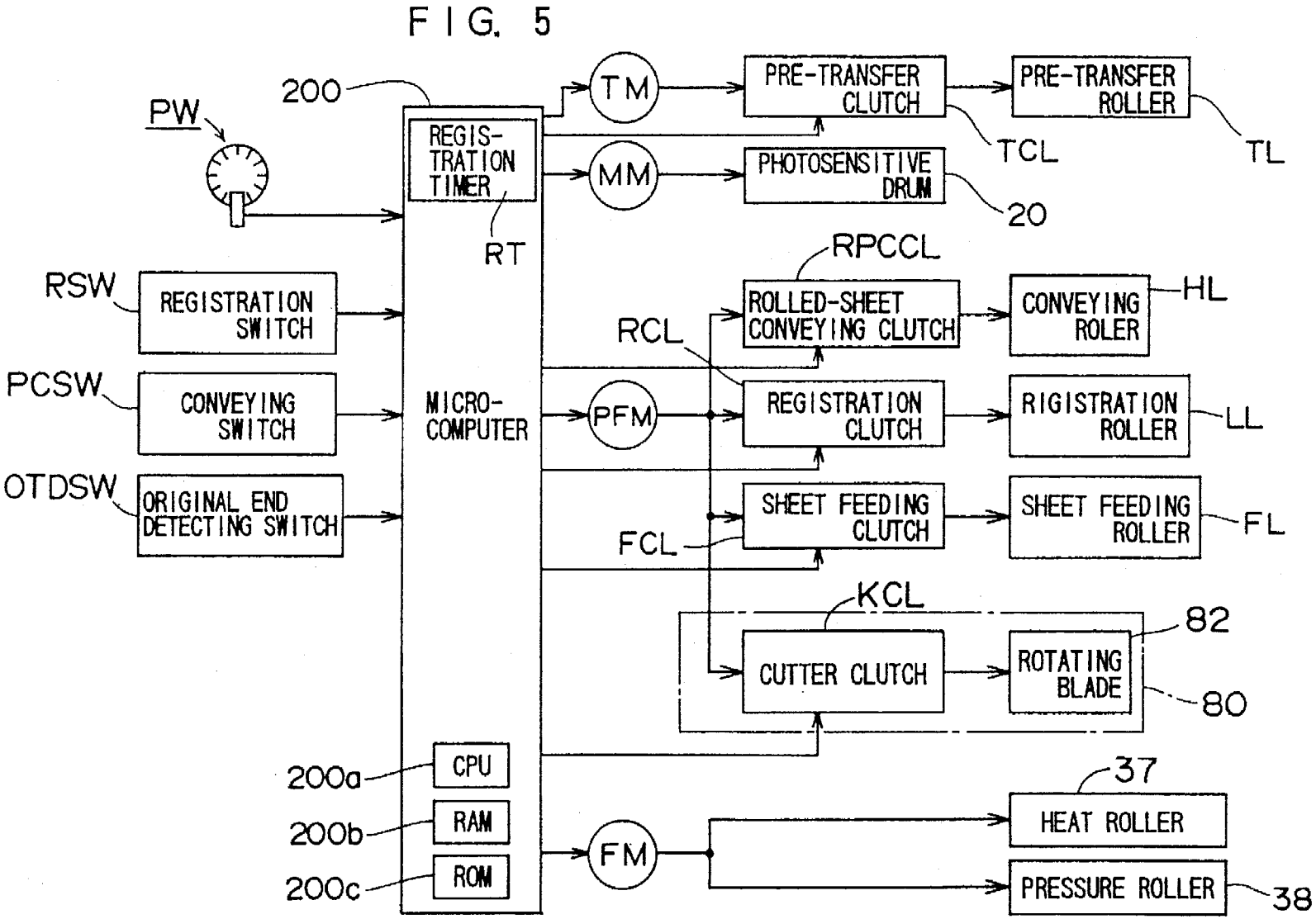
FIG. 5 is a block diagram showing the construction of a control circuit for performing conveying speed control processing which characterizes the copying machine shown in FIG. 1.

FIG. 5 is a block diagram showing the construction of a control circuit for performing conveying speed control processing which characterizes the copying machine. The copying machine is characterized in that it is so improved that the variation in tension exerted on the rolled-sheet 4 does not affect the rolled-sheet 4 which is being conveyed on the upstream side of the registration rollers LL in the direction of conveyance K, thereby making the length of a sheet obtained by the cutting (hereinafter referred to as "the cutting length") fixed. This is realized by making the sheet conveying speed of the rollers including the registration rollers LL higher than the sheet conveying speed of the pre-transfer rollers TL, as described later.

The control circuit shown in FIG. 5 is provided with a microcomputer 200 serving as driving controlling means and cutting controlling means, which functions as a control center. The microcomputer 200 includes a CPU 200*a*, a RAM 200*b* and a ROM 200*c*, and performs processing such as conveying speed control processing for controlling the sheet conveying speeds of the registration rollers LL and the pre-transfer rollers TL in accordance with a control program stored in the ROM 200*b*. The microcomputer 200 comprises a registration timer RT. The registration timer RT is used in performing the conveying speed control processing, as described later.

Signals are inputted from various switches and the like to the microcomputer 200. Specifically, a pulse signal outputted from the pulse output unit PW, an on/off signal outputted from the registration switch RSW, an on/off signal outputted from the conveying switch PCSW, and an on/off signal outputted from the second original end detecting switch OTDSW are inputted to the microcomputer 200. Although output signals of all the other switches shown in FIG. 1 are inputted to the microcomputer 200, the illustration of the output signals is omitted in FIG. 5 in order to make the construction easy to understood.

The microcomputer 200 controls various sections of the copying machine on the basis of the various signals inputted from the above-mentioned switches and the like. Specifically, the main motor MM for driving the photosensitive drum 20 or the like is controlled by the microcomputer 200.

The microcomputer 200 further controls on/off of the sheet feeding motor PFM and on/off of a rolled-sheet conveying clutch RPCCL, a registration clutch RCL and a sheet feeding clutch FCL respectively mounted on driving shafts which are arranged to transmit a driving force to the conveying rollers HL, the registration rollers LL and the sheet feeding rollers FL from the driving shaft MJ of the sheet feeding motor PFM. The microcomputer 200 further controls on/off of the pre-transfer motor TM and a pre-transfer clutch TCL for selectively transmitting to the pre-transfer rollers TL torque generated by the pre-transfer motor TM.

The microcomputer 200 further controls on/off of a cutter clutch KCL mounted on driving shafts which are arranged to transmit a driving force of the sheet feeding motor PFM to the rotating blade 82. The microcomputer further controls on/off of the fixing motor FM.

Figure 6:
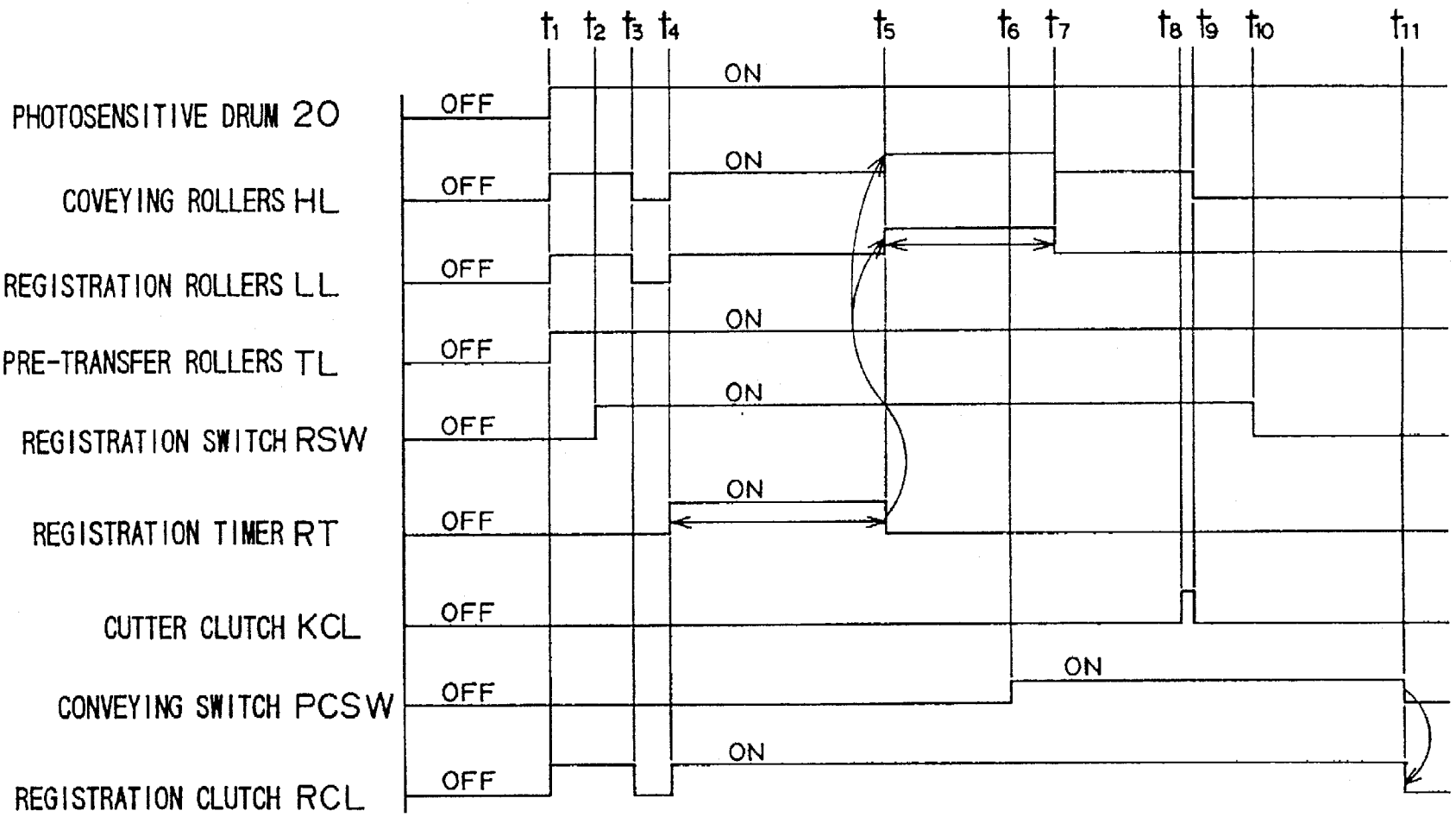
FIG. 6 is a timing chart for mainly explaining the operation of the control circuit.

The microcomputer 200 generally controls the rotational speeds of the sheet feeding motor PFM, the pre-transfer motor TM and the fixing motor FM so that the sheet conveying speed of the heat roller 37 and the pressure roller 38 is higher than the sheet conveying speed of the sheet feeding rollers FL, the conveying rollers HL, the registration rollers 37 and the pre-transfer rollers TL. Consequently, tension is applied to the sheet 4 which is subjected to fixing processing, to prevent the sheet 4 from being wrinkled. FIG. 6 is a timing chart for explaining the operation of the control circuit. FIG. 6 shows operation timing where the leading ends of the rolled-sheets 4 pulled out from the rolled-sheet bodies 4A to 4C wait in their home positions (positions on the downstream side of the leading end detecting switch RLDSW in the direction of conveyance K).

In a case where the rolled-sheet 4 waits in the home position, when the second original end detecting switch OTDSW is turned on upon conveyance of the original 9, the microcomputer 200 turns the main motor MM on ($t_1$). As a result, the photosensitive drum 20 is rotated along the direction of rotation 23. At the same time, the sheet feeding motor PFM, the roll conveying clutch RPCCL, the registration clutch RCL and the pre-transfer clutch TCL are turned on. As a result, the conveying rollers HL, the registration rollers LL and the pre-transfer rollers TL are driven, whereby the rolled-sheet 4 waiting in the home position is conveyed in the direction of conveyance K along the conveying path D.

In this state, when the rolled-sheet 4 reaches the registration switch RSW, the registration switch RSW is turned on ($t_2$). Subsequently, microcomputer 200 turns off, after sufficient time to engage the leading end of the rolled-sheet with the registration rollers LL has elapsed ($t_3$), the rolled-sheet conveying clutch RPCCL and the registration clutch RCL. As a result, the rolled-sheet 4 is stopped in a state where the leading end thereof is engaged with the registration rollers LL. Consequently, primary sheet feeding is completed.

Thereafter, the microcomputer 200 turns the rolled-sheet conveying clutch RPCCL and the registration clutch RCL on in response to an elapse of time required to synchronize the conveyance of the original 9 and the conveyance of the rolled-sheet 4 ($t_4$) after the rolled-sheet conveying clutch RPCCL and the like are turned on ($t_1$). As a result, the conveyance of the rolled-sheet 4 is resumed. That is, secondary sheet feeding is started.

At this time, the sheet feeding motor PFM and the pre-transfer motor TM are controlled so that the sheet conveying speed of the sheet feeding rollers FL, the conveying rollers HL, and the registration rollers LL is equal to the sheet conveying speed of the pre-transfer rollers TL. Specifically, the sheet feeding motor PFM and the pre-transfer motor TM are controlled so that the sheet conveying speed is 80 (mm/sec), for example.

Furthermore, in the microcomputer 200, measurement of time by the registration timer RT is started in response to the start of the secondary sheet feeding. The measurement of time by the registration timer RT is terminated ($t_5$) after sufficient time for the leading end of the rolled-sheet 4 to reach the pre-transfer rollers TL has elapsed since the beginning of the secondary sheet feeding. When the measurement of time by the registration timer RT is terminated, therefore, the leading end of the rolled-sheet 4 is in a state where it is engaged with the pre-transfer rollers TL. The microcomputer 200 performs conveying speed control processing which characterizes the present embodiment in response to the termination of the measurement of time by the registration timer RT.

That is, in the conveying speed control processing, the sheet feeding motor PFM and the pre-transfer roller TM are so controlled that the sheet conveying speed of the sheet feeding rollers FL, the conveying rollers HL and the registration rollers LL is higher than the sheet conveying speed of the pre-transfer rollers TL. Specifically, the rotational speed of the sheet feeding motor PFM is increased so that the sheet conveying speed of the sheet feeding rollers FL, the conveying rollers HL and the registration rollers LL becomes 90 (mm/sec) with the sheet conveying speed of the pre-transfer rollers TL being 80 (mm/sec). Consequently, the sheet conveying speed on the downstream side of the registration rollers LL in the direction of sheet conveyance is made lower than the sheet conveying speed on the upstream side thereof. As a result, there is slack formed in the rolled-sheet 4 between the registration rollers LL and the pre-transfer rollers TL, so that the portion of the rolled-sheet 4 is in a loop shape.

The conveying speed control processing is continuously performed for a time period during which sufficient slack to be held until the copying operation is terminated can be provided in the rolled-sheet 4 ($t_7$). Specifically, the conveying speed control processing is continuously performed for a time period required to provide 10 (mm) slack in the rolled-sheet 4. That is, the sheet feeding length by the registration rollers LL and the like in a time period from time $t_5$ to time $t_7$ is larger by 10 (mm) than the sheet feeding length by the pre-transfer rollers TL in the time period.

While the conveying speed control processing is performed, the leading end of the rolled-sheet 4 reaches the conveying path 34, to turn the conveying switch PCSW on ($t_6$).

The microcomputer 200 starts counting of the number of pulses outputted from the pulse output unit PW after the conveying speed control processing is terminated. At the same time, monitoring as to whether the counted number of pulses reaches a predetermined reference number of pulses is also started.

The reference number of pulses is previously set so that the cutting length becomes a desirable length. More specifically, the feeding length of the rolled-sheet 4 in a time period elapsed from the time when the leading end of the rolled-sheet 4 passes through the position for cutting 83 (see FIG. 1) until the conveying speed control processing is terminated can be calculated on the basis of the rotational speed of the sheet feeding motor PFM in this time period. Consequently, the feeding length of the rolled-sheet 4 conveyed during the above-mentioned time period has been already known. Therefore, the number of pulses corresponding to a length obtained by subtracting the sheet feeding length during the time period from the desirable cutting length is set as the reference number of pulses.

When the counted number of pulses reaches the reference number of pulses ($t_8$) as a result of the above-mentioned monitoring, the cutter clutch KCL is turned on for only a predetermined time period. As a result, the rotating blade 82 rotates, whereby the rolled-sheet 4 is cut in the position for cutting 83.

Thereafter, the rolled-sheet conveying clutch RPCCL is turned off ($t_9$). Consequently, the conveyance of the rolled-sheets 4 on the side of the rolled-sheet bodies 4A to 4C is stopped. On the other hand, sheets obtained by the cutting are conveyed as they are in the direction of conveyance K. Consequently, the registration switch RSW is turned off after an elapse of a predetermined time period ($t_{10}$). Further, the conveying switch PCSW is turned off after an elapse of a predetermined time period ($t_{11}$). When the conveying switch PCSW is turned off, the registration clutch RCL is turned off.

Figure 7A:
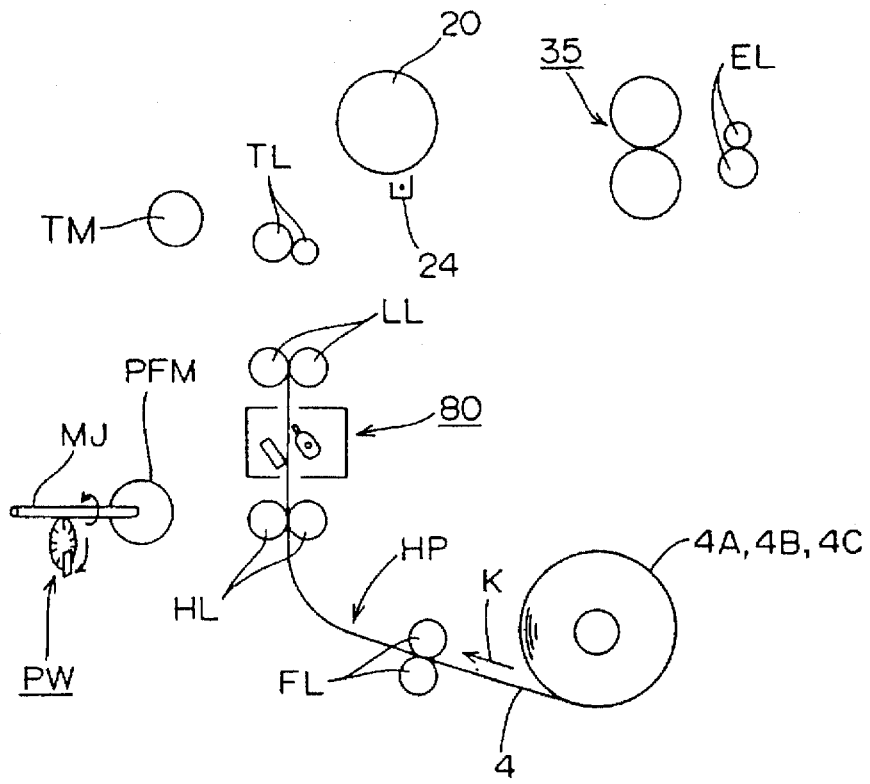
FIGS. 7A and 7B are conceptual diagrams for specifically explaining the characteristics of the copying machine shown in FIG. 1.
Figure 7B:
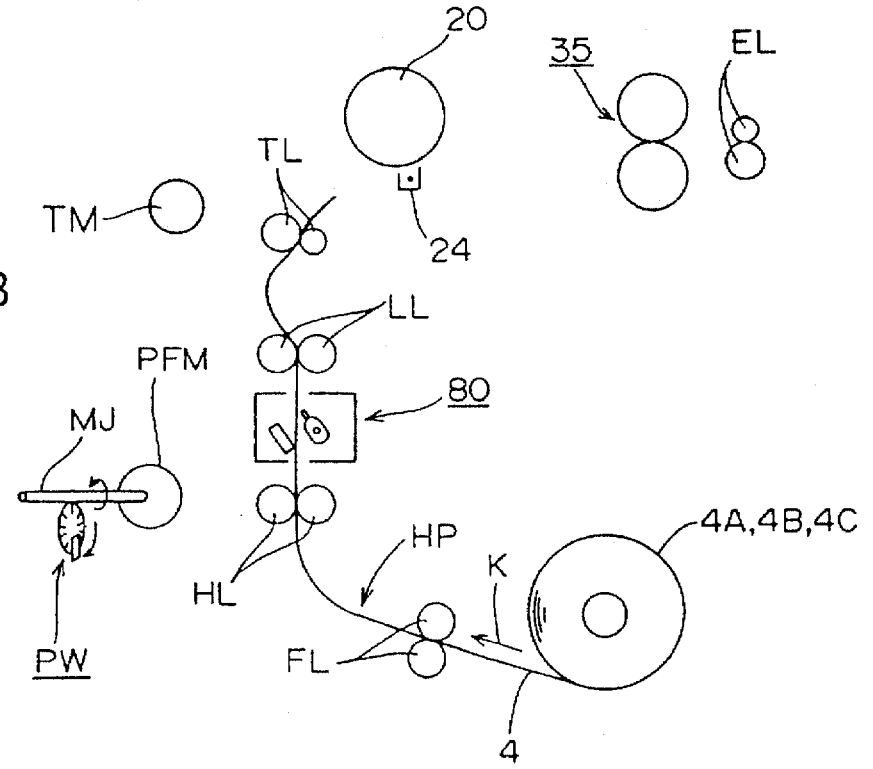
Figure 8:
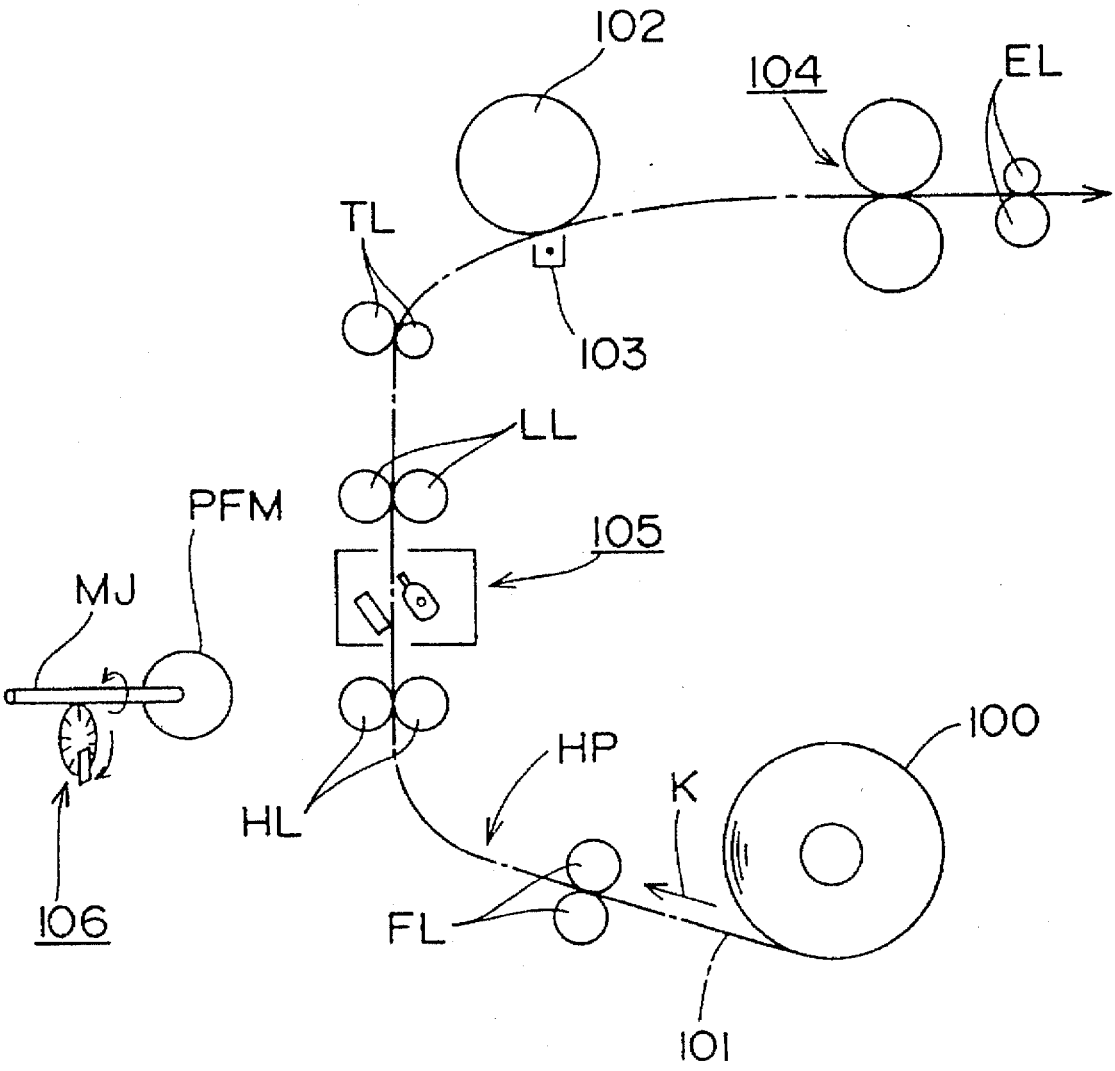
FIG. 8 is a diagram for explaining the form of conveying a rolled-sheet.

FIG. 7A and 7B are conceptual diagrams for specifically explaining the characteristics of the copying machine. When the copying is started, the rolled-sheet 4 pulled out from each of the rolled-sheet bodies 4A to 4C is fed by primary sheet feeding, and is stopped once in a state where it is engaged with the registration rollers LL (see FIG. 7A). Thereafter, the rolled-sheet 4 is fed by secondary sheet feeding. When the rolled-sheet enters a state where it enters the pre-transfer rollers TL, the sheet conveying speed of the sheet feeding rollers FL, the conveying rollers HL and the registration rollers LL is made higher than the sheet conveying speed of the pre-transfer rollers TL. As a result, there is slack formed in the rolled-sheet 4 conveyed between the registration rollers LL and the pre-transfer rollers TL, so that the portion of the rolled-sheet 4 is in a loop shape (see FIG. 7B). Thereafter, a toner image formed on the photosensitive drum 20 is transferred to the rolled-sheet 4.

The rolled-sheet 4 after the transfer is led to and enter the fixing device 35. At this time, the sheet conveying speed of the fixing device 35 is made higher than the sheet conveying speed of the pre-transfer rollers TL, whereby tension is exerted on the rolled-sheet 4. As a result, the rolled-sheet 4 enters a state where it is pulled. The tension exerted on the rolled-sheet 4 at this time varies depending on a temperature at which toner particles are fixed by heating in the heat roller 38.

On the other hand, the rolled-sheet 4 between the registration rollers LL and the pre-transfer rollers TL is slack in a loop shape, whereby the variation in the tension is absorbed by the slack. As a result, the variation in the tension exerted on the rolled-sheet 4 does not so affect the rolled-sheet 4 on the upstream side of the pre-transfer rollers TL in the direction of conveyance K. Consequently, the variation in the tension exerted on the sheet 4 between the pre-transfer rollers TL and the fixing device 35 does not affect the feeding length of the rolled-sheet 4 by the registration rollers LL. Consequently, the relationship between the number of pulses outputted from the pulse output unit PW and the sheet length fed by the registration rollers LL is kept constant irrespective of the tension.

If the rolled-sheet 4 is cut at timing when the number of pulses, the counting of which is started at the same time that the conveying speed control processing is terminated, reaches the reference number of pulses, the rolled-sheet 4 can be accurately cut to a desirable length. Consequently, the variation in the cutting length of the rolled-sheet 4 can be significantly restrained.

Although description has been made of the embodiment of the present invention, the present invention is not limited to the above-mentioned embodiment. For example, in the above-mentioned embodiment, the rotational speed of the sheet feeding motor PFM is increased in a time period immediately after the leading end of the rolled-sheet 4 has reached the pre-transfer rollers TL, to provide slack in the rolled-sheet 4. Before the leading end of the rolled-sheet 4 reaches the fixing device 35, however, tension by the heat roller 37 and the pressure roller 38 is not exerted on the rolled-sheet 4. Consequently, the increase in the rotational speed of the sheet feeding motor PFM may be started at an arbitrary time point from the time when the leading end of the rolled-sheet 4 has reached the pre-transfer rollers TL to the time when the leading end reaches the rollers 37 and 38 in the fixing device 35. According to such an arrangement, the tension exerted on the rolled-sheet 4 does not affect the conveyance of the rolled-sheet 4 by the registration rollers LL and the like.

In the above-mentioned embodiment, a predetermined time period during which the rotational speed of the sheet feeding motor PFM is increased is determined so that slack in the sheet between the registration rollers LL and the pre-transfer rollers TL is held until the copying operation is completed. After the cutting by the cutting mechanism 80 is completed, however, the cutting length of the sheet is not affected even if there is no slack in the sheet. Consequently, the predetermined time period during which the rotational speed of the sheet feeding motor PFM is increased may be sufficient time to hold a state where there is slack until completion of the cutting by the cutting mechanism 80.

Furthermore, in the above-mentioned embodiment, the cutting mechanism 80 is disposed on the upstream side of the registration rollers LL with respect to the direction of sheet conveyance. Even if the cutting mechanism is disposed on the downstream side of the registration rollers LL with respect to the direction of sheet conveyance, however, there is not any problems in obtaining sheets having a desirable cutting length so long as the cutting mechanism is positioned in the close vicinity of the registration rollers LL.

Although in the above-mentioned embodiment, description has been made by taking a copying machine as an example, the present invention is applicable to the other image forming apparatus such as a printer. Further, the present invention is also applicable to an apparatus for forming an image by a process other than an electrophotographic process, for example, an ink-jet process or a thermal transfer process.

Although the present invention has been described and illustrated in detail, it is clearly understood that the description is by way of illustration and example only and is not to be taken by way of limitation, the spirit and scope of the present invention being limited only by the terms of the appended claims.

What is claimed is:

1. An image forming apparatus for forming an image on a sheet having a predetermined length cut from a strip-shaped continuous sheet, comprising:

image forming means for forming an image on a sheet;

a feeding roller for feeding a strip-shaped continuous sheet to the image forming means;

a pre-image-formation roller provided between the feeding roller and the image forming means;

cutting means, provided on an upstream side of the pre-image-formation-roller with respect to a direction of sheet conveyance, for cutting the strip-shaped continuous sheet;

pre-image-formation roller driving means for driving the pre-image-formation roller to rotate so that a sheet conveying speed of the pre-image-formation roller is equal to a predetermined speed;

feeding roller driving means for driving the feeding roller to rotate;

sheet feeding length detecting means for detecting a sheet feeding length by the feeding roller;

cutting controlling means for driving the cutting means in response to that the sheet feeding length detected by the sheet feeding length detecting means has reached a predetermined value;

a post-treatment roller provided on a downstream side of the image forming means with respect to the direction of sheet conveyance;

post-treatment roller driving means for driving the post-treatment roller to rotate so that a sheet conveying speed of the post-treatment roller is higher than the sheet conveying speed of the pre-image-formation roller; and driving controlling means for controlling the feeding roller driving means so that a sheet conveying speed of the feeding roller is higher than the sheet conveying speed of the pre-image-formation roller during a predetermined time period after a leading end of the continuous sheet has reached the pre-image-formation roller, thereby providing slack in the sheet between the feeding roller and the pre-image-formation roller such that the slack absorbs tension exerted by the post-treatment roller to prevent the tension from affecting the rotation of the feeding roller, wherein the feeding roller, the pre-image-formation roller and the post treatment roller are driven so that the slack is formed before the leading end of the sheet has reached the post-treatment roller.

2. An image forming apparatus according to claim 1, wherein the feeding roller includes a registration roller, and the cutting means is provided on an upstream side of the registration roller with respect to the direction of sheet conveyance.

3. An image forming apparatus according to claim 1, wherein the image forming means is for forming an image on a sheet by an electrophotographic process, and the post-treatment roller is a fixing roller for fixing to the sheet the image transferred to the sheet.

4. An image forming apparatus according to claim 1, wherein the driving controlling means controls the feeding roller driving means so that the sheet conveying speed of the feeding roller is higher than the sheet conveying speed of the pre-image-formation roller for sufficient time to hold a state where there is slack in the sheet between the feeding roller and the pre-image-formation roller until completion of the cutting by the cutting means.

5. An image forming apparatus according to claim 1, wherein the cutting means is actuated to cut the continuous sheet while the sheet is being conveyed.

6. A sheet feeding method in an image forming apparatus for forming an image on a sheet having a predetermined length cut from a strip-shaped continuous sheet, the method comprising the steps of:

feeding a strip-shaped continuous sheet toward image forming means an image on the sheet.

providing slack in the sheet short of the image forming means:

measuring a sheet feeding length short of the slack; and cutting the sheet when the measured sheet feeding length has reached a predetermined value;

the step of providing slack in the sheet including the step of making a sheet conveying speed of a feeding roller for feeding the sheet toward the image forming means higher than a sheet conveying speed of a pre-image formation roller provided short of the image forming means during a predetermined time period, thereby providing sufficient slack between the feeding roller and the pre-image information roller to absorb tension exerted by a post-treatment roller so as to prevent the tension from affecting the rotation of the feeding roller, the post-treatment roller being provided downstream of the image forming means with respect to the direction of sheet conveyance.

7. A method according to claim 6, wherein the steps of measuring the sheet feeding length includes the step of detecting rotation of the feeding roller.

8. A method according to claim 6, wherein the feeding roller includes a registration roller, and the sheet is cut on an upstream side of the registration roller with respect to a direction of sheet conveyance.

9. A method according to claim 6, wherein the continuous sheet is cut while the sheet is being conveyed.

* * * * *